US010907792B2

(12) United States Patent
Spork et al.

(10) Patent No.: US 10,907,792 B2
(45) Date of Patent: Feb. 2, 2021

(54) ILLUMINATING DEVICE FOR VEHICLES

(71) Applicant: Hella GmbH & Co. KGaA, Lippstadt (DE)

(72) Inventors: Heinz-Uwe Spork, Lippstadt (DE); Franz-Georg Willeke, Anröchte (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/470,334

(22) PCT Filed: Dec. 5, 2017

(86) PCT No.: PCT/EP2017/081446
§ 371 (c)(1),
(2) Date: Jun. 17, 2019

(87) PCT Pub. No.: WO2018/114315
PCT Pub. Date: Jun. 28, 2018

(65) Prior Publication Data

US 2020/0116327 A1 Apr. 16, 2020

(30) Foreign Application Priority Data

Dec. 19, 2016 (DE) ..... 10 2016 124 763

(51) Int. Cl.
*F21S 41/141* (2018.01)
*F21S 45/43* (2018.01)
(Continued)

(52) U.S. Cl.
CPC ..... *F21S 45/43* (2018.01); *F21S 41/141* (2018.01); *F21S 45/47* (2018.01); *F21Y 2115/10* (2016.08)

(58) Field of Classification Search
CPC .. F21S 45/42; F21S 45/43; F21S 45/47; F21S 41/141
See application file for complete search history.

(56) References Cited

U.S. PATENT DOCUMENTS 6,846,096 B2 * 1/2005 Hsu ..... G03B 21/16 362/218
8,147,109 B2 * 4/2012 Wan ..... F21V 29/02 362/547
(Continued)

FOREIGN PATENT DOCUMENTS

DE 102004025624 A1 12/2005
DE 102005043499 A1 3/2007
(Continued)

*Primary Examiner* — Arman B Fallahkhair
(74) *Attorney, Agent, or Firm* — Husch Blackwell LLP

(57) ABSTRACT

An illuminating device for vehicles with at least one light module that has a semiconductor-based light source and a carrier plate holding the semiconductor-based light source that extends along a base area of the light module. The illuminating device also includes a fan for the purpose of generating an airflow ($L_G$) that can be guided by means of an air guide along the base area of the light module. An injector is provided for as light guide that is designed in such a way that a main airflow ($L_1$) flowing through a housing of the fan and a secondary air flow ($L_2$) not flowing through the housing of the fan can be guided to the base area of the light module.

8 Claims, 1 Drawing Sheet

(51) Int. Cl.
*F21Y 115/10* (2016.01)
*F21S 45/47* (2018.01)

(56) References Cited

U.S. PATENT DOCUMENTS

| | | | | |
|---|---|---|---|---|
| 9,829,173 | B2 * | 11/2017 | Kim | H01L 35/02 |
| 10,228,105 | B2 * | 3/2019 | Chiron | F21S 41/00 |
| 10,317,038 | B2 * | 6/2019 | Vosmik | F21S 45/43 |
| 10,337,690 | B2 * | 7/2019 | Tessnow | F21S 41/28 |
| 2007/0127257 | A1 * | 6/2007 | Erion | F21V 29/75 362/547 |
| 2009/0080211 | A1 * | 3/2009 | Yasuda | F21S 45/435 362/547 |
| 2011/0051453 | A1 * | 3/2011 | Nagasawa | B60Q 1/007 362/547 |
| 2012/0092885 | A1 * | 4/2012 | Hong | F21S 41/148 362/547 |
| 2019/0072255 | A1 * | 3/2019 | Kato | F21S 45/47 |
| 2020/0003390 | A1 * | 1/2020 | Menn | F21S 45/43 |

FOREIGN PATENT DOCUMENTS

| | | | |
|---|---|---|---|
| DE | 102012108773 | A1 | 3/2014 |
| DE | 102014106342 | A1 | 11/2015 |
| EP | 2607784 | A1 | 6/2013 |
| EP | 3246619 | A1 | 11/2017 |
| JP | 2016031777 | A | 3/2016 |
| WO | 2016013208 | A1 | 1/2016 |

* cited by examiner

ILLUMINATING DEVICE FOR VEHICLES

CROSS REFERENCE

This application claims priority to PCT Application No. PCT/EP2017/081446, filed Dec. 5, 2017, which itself claims priority to German Patent Application 10 2016 124763.4, filed Dec. 19, 2016, the entirety of both of which are hereby incorporated by reference.

FIELD OF THE INVENTION

The invention relates to an illuminating device for vehicles with at least one light module that has a semiconductor-based light source and a carrier plate holding the semiconductor-based light source which extends along a base area of the light module and with a fan to generate an airflow that can be guided by means of an air guide along the base area of the light module.

BACKGROUND

An illuminating device is known from DE 10 2014 106 342 A1 that includes a light module with a semiconductor-based light source and a carrier plate holding the same. Connecting to the carrier plate there is a heat sink in which air ducts are integrated. For the purpose of generating an airflow, there is a fan arranged at a distance from the light module. Air guides are arranged between the fan and the light module such that the airflow generated by the fan can be guided in the direction of the air ducts. The air ducts effect an efficient dissipation of the heat from the semiconductor-based light source. The airflow guided along the carrier plate or along the base area of the light module formed in such a way is determined in this respect by the dimension of the fan.

SUMMARY OF THE INVENTION

The task of the present invention is to further develop an illuminating device for vehicles such that the efficiency of the dissipation of the heat from a light module is increased with little effort.

To solve this task, an injector is provided for as light guide that is designed in such a way that a main airflow flowing through a housing of the fan and a secondary airflow not flowing through the housing of the fact can be guided to the base area of the light module.

As defined by the invention, there is an injector arranged between a fan and a light module that not only guides to the light module a main airflow flowing through the housing of the fan but also a secondary airflow not flowing through the housing of the fan. Advantageously, this can increase the throughflow rate of the same airflow (total airflow) that can be guided to the light module or a base area. The basic concept of the invention consists of exploiting the suction capacity of the fan in addition to the intake of a secondary airflow that preferentially flows into the injector alongside the fan. Advantageously, this can increase the airflow throughput and thus improve the dissipation of the heat from the light module.

According to a preferred embodiment of the invention, the injector is tapered in the direction of the light module, where an opening cross-section of an inlet of the injector is larger on the side facing away from the light module than an outlet opening cross-section of the fan. The tapered or funnel shaped design of the injector allows the flow of air to increase and thus improve the dissipation of heat from the light module.

According to one embodiment of the invention, the injector is joined, on the light module side, to the carrier plate and/or a heat sink attached to the carrier plate. A closed light duct is thus formed between the light module and the fan with the exception of a secondary inlet that ends directly at the point of heat dissipation.

According to one embodiment of the invention the injector continually tapers in the direction of the light module. A continual increase in the airflow velocity is thus effected that is preferentially the highest in the area of the light module.

According to one embodiment of the invention the injector firstly has a main inlet and secondly a smaller (in comparison to the first) secondary inlet on the side facing away from the light module. The main inlet has an opening cross-section that corresponds to the outlet opening cross-section of the fan.

Advantageously, a negative pressure generated by the fan can suck in additional air through the secondary inlet and then guided to the light module.

According to a preferred embodiment of the invention, the secondary inlet of the injector is arranged as neighboring the main inlet in such a way that a secondary airflow flows in at an acute angle to the main airflow into the injector. The main and secondary airflows thus enter the injector essentially at the same angle or within a small range of angles. This means that the flow rate can be continually increased free of turbulence.

According to a further embodiment of the invention, the secondary inlet is arranged oriented at a right angle and/or an obtuse angle to the main inlet so that air from a completely different direction than from the fan can be sucked into the injector. For example, the secondary airflow can be air from the area of a neighboring light module that might already be warmed up. The fact that the air warmed up by the neighboring light module is not fed into the injector or to the specific light module through the fan as main airflow but past the fan as a secondary airflow extends the working life of the fan.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

An illuminating device for vehicles is arranged, for example, in a housing that is arranged closed by a cover glass. The illuminating device can be designed as a headlight or rear light in a vehicle.

Figure 1:
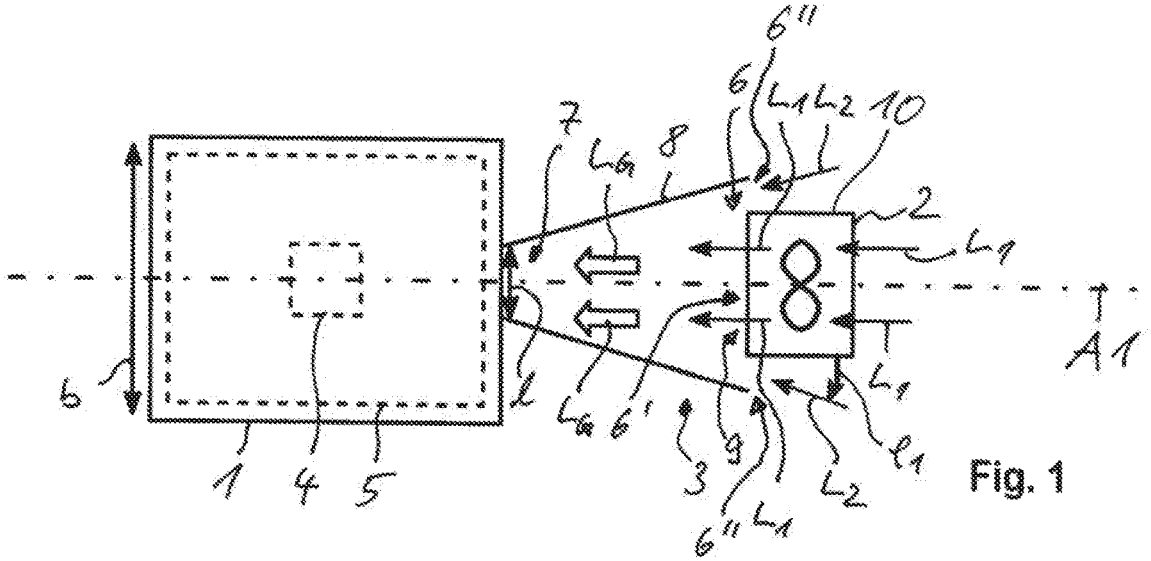
FIG. 1 is a schematic rear view of the light module with a fan and an injector in accordance with one the first embodiments.

According to a first embodiment of the invention according to FIG. 1, the illuminating device comprises a light module 1 and a fan 2 as well as an injector 3 arranged between the light module 1 and the fan 2.

The light module 1 has a number of semiconductor-based light sources 4, for example LED light sources as well as a carrier plate 5 that accommodates the number of light sources 4. The carrier plate 5 is, for example, designed as a printed circuit board. In the present embodiment, the light module 1 acts to generate a specified light distribution, for example to generate a low-beam and/or high-beam light distribution of a headlight. In this case, the semiconductor-based light source 4 is designed as an LED chip. As an option, a heat sink can connect on a side of the carrier plate 5 facing away from the light source 4 (not shown in FIG. 1). The carrier plate 5 and, as the case may be, additionally the heat sink form a base area of the light module 1 that runs essentially level and vertical to the radiation direction of the light source 4.

The injector 3 acts as an air guide to guide an airflow or total airflow $L_G$ from an intake 6 arrange on a side of the injector 3 facing away from the light module 1 in the direction of an outlet 7 of the injector 3 arranged on an end facing the light module. In the present embodiment, the outlet 7 of the injector 3 directly connects to a edge of the carrier plate 5. Alternatively or in addition, the outlet 7 can also connect to the heat sink of the light module 1.

The injector 3 has a wall 8 that is designed as tapering and/or funnel-shaped in the direction of the light module 1. An opening cross-section of the inlet 6 of the injector 3 is designed to be larger than an opening cross-section of the outlet 7 of the injector 3. The reduction in the cross-section in the direction of the light module 1 causes an increase in the flow velocity of the total airflow $L_G$ when passing through the injector 3. The increased flow rate brings about an improvement in the dissipation of heat from the light module 1.

The outlet 7 of the injector 3 is preferentially designed with a rectangular cross-section, where one length l is shorter than one width b of the carrier plate 5. The light source 4 is arranged at the center of carrier plate 5 to which the fan 2 or, as the case may be, the injector 3, is aligned. One axis forms a central axis of the fan 2 and runs at one level of the carrier plate 5 and/or the light source 4.

In the present embodiment, the wall 8 of the injector 3 basically runs level. Alternatively, the run of wall 8 can also take the form of an arch. The cross-section of the injector 3 decreases at any event preferentially continually from the inlet 6 in the direction of the outlet 7.

The inlet 6 of the injector 3 is, firstly, formed by a main inlet 6' with an opening cross-section that corresponds to an outlet opening cross-section 9 of the fan 2. An airflow $L_1$ is introduced exclusively through the main inlet 6'; this airflow is sucked in through a housing 10 of the fan 2.

Secondly, the inlet 6 includes a secondary inlet 6" that is arranged as neighboring main inlet 6' or the fan 2, respectively. An airflow $L_2$ is sucked in through this secondary inlet 6", the opening cross-section of which is preferentially smaller than the opening cross-section 9 of the main inlet 6', from a space neighboring the fan 2. The secondary airflow $L_2$ is an airflow that does not flow through the housing 10 of the fan 2. Instead the fan 2 uses the main airflow L to generate negative pressure that leads to the secondary airflow $L_2$ to be sucked in such that the main airflow $L_1$ is overlapped by secondary airflow $L_2$ to form the total airflow $L_G$.

The overlapping takes place relatively turbulence-free as the secondary airflow $L_2$ is sucked in at an acute angle $\varphi 1$ to the main airflow $L_1$. Due to the tapering of injector 3, the total airflow $L_G$ undergoes over the further course an increase in velocity such that the light module 1 can be provided with a higher flow rate, in relation to the inlet 6, for the dissipation of heat from the light module 1.

In the present embodiment, the wall 8 of the injector 3 runs in the shape of a rectangle or an oval at the end facing away from the light module 1, where the secondary inlet 6" is arranged to run around the main inlet 6'.

The main airflow $L_1$ is directed to the injector 3 basically in the direction of the axis A1. For this purpose, the axis A1 of the fan 2 or a fan propeller, respectively, of the same is arranged coaxially to injector 3. The axis A1 can act as central axis of the fan 2 and the injector 3.

Alternatively, the injector 3 can also be designed in the shape of a circle in its cross-section. In any case, the injector 3 is designed in the shape of a tube, where wall 8 runs continuously from the end of the injector 3 arranged on the side facing away from the light module 1 to the end arranged on the side facing towards the light module 1.

The injector 3 can, for example, be exclusively connected to the light module 1, while the fan 2 is exclusively connected to a housing (not depicted) of the illuminating device or headlight, as the case may be. Advantageously, this approach can bridge component tolerances and settings between the light module assembly and the fan via the injector. The light assembly formed by the light module is lighter as it does not have to contain the fan 2. Advantageously, the fan 2 can, if necessary, be better electronically contacted at the housing of the illuminating device.

Figure 2:
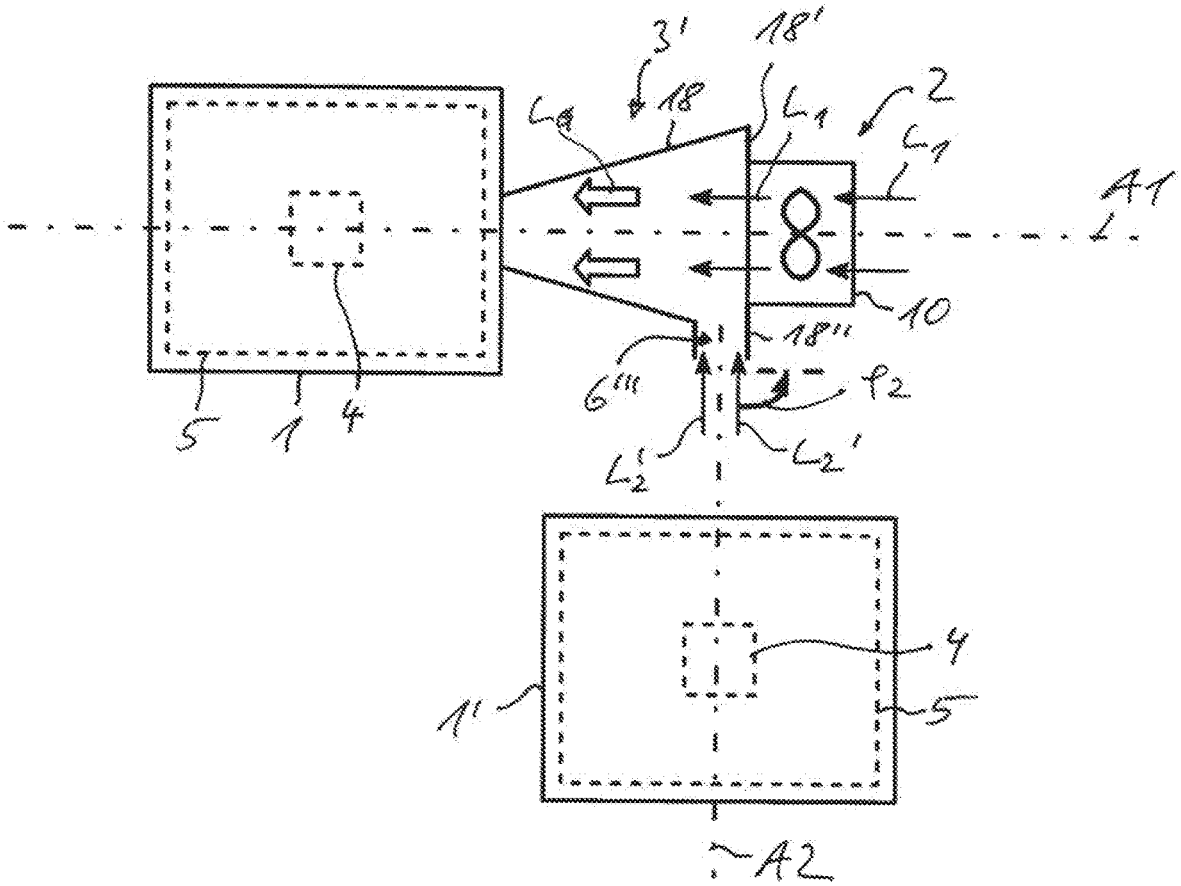
FIG. 2 is a schematic rear view of two neighboring light modules and an injector allocated to a first light module according to a second embodiment.

A further embodiment of the invention according to FIG. 2 differs from the embodiment according to FIG. 1 in that it provides for an injector 3' that has such a wall 18 that a secondary inlet 6''' of the injector 3' is arranged oriented at a right angle $\varphi 2$ to the central axis A1 or to the direction of the main $airflow_1$. The secondary inlet 6''' is arranged oriented to a further neighboring light module 1', so that the air can be sucked in from an area of the further light module 1' and flow as secondary airflow $L_2'$ into the injector 3' through the secondary inlet 6'''. The direction of the secondary $L_2'$ runs basically at an angle $\varphi_2$ vertical to the direction of the main airstream $L_1$. Advantageously, this make it possible for a potentially already slightly warmed airflow $L_2'$ that does not pass through or flow through the housing of fan 2 in addition to the main airflow $L_1$ flowing through the fan 2. This can extend the working life of fan 2.

According to a further embodiment (not depicted) of the invention, the secondary inlet 6''' can also be arranged at an obtuse or at an acute angle, depending on the dimensions at which the light modules 1, 1' arranged offset to each other. In the present embodiment according to FIG. 2, the further light module 1' is arranged as an extension of a central axis A2 of the secondary inlet 6''' so that basically the air present in the area of the further light module 1' is sucked in. The secondary inlet 6''' is, for example, designed with a circular or oval or rectangular cross-section. The wall 18 is designed in such a way that the corresponding wall parts 18', 18" directly connect to the housing 10 of the fan 2 so that only one single secondary inlet 6" is provided for.

According to a further embodiment (not depicted) of the invention, the wall 18 can also be designed in such a way that, in addition, a further secondary inlet is arranged especially on a side of the injector 3 opposite the secondary inlet 6'''.

According to an alternative embodiment, the wall 8, 18 can also be tapered in regular or erratic steps in the direction of the light module 1.

The injector 3' is preferentially permanently connected to the light module 1 and/or with the fan 2.

It is understood that the aforementioned features can be used alone or in any potential combination of two or more. The list of embodiments described should not be deemed exhaustive.

LIST OF REFERENCE NUMBERS

1,1' Light module
2 Fan
3,3' Injector
4 Light source
5 Carrier plate
6,6',6",6'" Inlet
7 Outlet
8 Wall
9 Outlet opening cross-section
10 Housing
18,18',18" Wall
$L_G$ Total airflow
$L_1$ Main airflow
$L_2$,$L_{2'}$. Secondary airflow
l Length
b Width
A1 Axis
A2 Central axis
φ1,φ2 Acute angle

The invention claimed is:

1. An illuminating device for vehicles, the illuminating device comprising:

at least one light module, the at least one light module including:

a semiconductor-based light source; and a carrier plate holding the semiconductor-based light source, said carrier plate extending along a base area of the light module; and a fan to generate an airflow guided along the base area of the light module by means of an air guide; and an injector acting as the air guide, the injector including:

a wall tapered in the direction of the light module;

an inlet facing away from the light module, the inlet including:

a main inlet defined by a wider end of the tapered wall having an opening cross-section that corresponds to an outlet opening cross-section of the fan to allow passage of a main air flow through a housing of the fan, and a secondary inlet with an opening cross-section that is smaller than the opening cross-section of the main inlet to allow passage of a secondary air flow; and an outlet defined by a narrower end of the tapered wall facing toward the semiconductor-based light source of the light module; and wherein each of the main air flow and the secondary air flow are guided to the base area of the light module.

2. The illuminating device in accordance with claim 1, wherein the secondary airflow flows in through the secondary inlet at a right angle or an obtuse angle to the main airflow that is sucked into the injector.

3. The illuminating device in accordance with claim 2, wherein the secondary inlet of the injector is arranged such that air from a neighboring further light module is sucked in by the fan as the secondary airflow.

4. The illuminating device in accordance with claim 3, wherein the further light module is arranged as an extension of a central axis of the secondary inlet of the injector.

5. The illuminating device in accordance with claim 1 wherein the injector, on a side facing the light module, connects to the carrier plate or a heat sink adjacent to the carrier plate.

6. The illuminating device in accordance with claim 1 wherein the wall of the injector is designed in such a way that a cross-section of the injector continually tapers from the inlet facing away from the light module to the outlet facing towards the light module.

7. The illuminating device in accordance with claim 1, wherein the secondary airflow flows at an acute angle to the main airflow into the injector.

8. The illuminating device in accordance with claim 1 wherein the injector is designed in the shape of a tube with a rectangular, circular or oval cross-section.

* * * * *